United States Patent [19]

Budnik

[11] Patent Number: 4,744,915

[45] Date of Patent: May 17, 1988

[54] 2-METHYLCYCLOHEXOXY END BLOCKED ABA TYPE SILICONE FLUIDS AND THEIR USE AS BRAKE FLUIDS

[75] Inventor: Richard A. Budnik, Mt. Kisco, N.Y.

[73] Assignee: Union Carbide Corporation, Danbury, Conn.

[21] Appl. No.: 88,289

[22] Filed: Aug. 24, 1987

[51] Int. Cl.[4] ..... C10M 105/76; C07F 7/08

[52] U.S. Cl. ..... 252/78.3; 252/49.6; 556/457

[58] Field of Search ..... 252/49.6, 78.3; 556/457

[56] References Cited

U.S. PATENT DOCUMENTS

| | | | |
|---|---|---|---|
| 2,834,748 | 5/1958 | Bailey et al. | 252/78.3 |
| 3,732,169 | 5/1973 | Burrous et al. | 252/78 |
| 3,813,425 | 5/1974 | Traver | 260/448.2 |
| 3,821,114 | 6/1974 | Brown, Jr. | 252/78 |
| 3,965,135 | 6/1976 | Knollmueller | 260/448.8 |
| 3,974,080 | 8/1976 | Coffman et al. | 252/78.3 |
| 3,984,449 | 10/1976 | Brown, Jr. | 252/78.3 |
| 4,056,546 | 11/1977 | Brown, Jr. | 260/448.8 |
| 4,116,847 | 9/1987 | Knollmueller | 252/78.3 |
| 4,244,831 | 1/1981 | Cupper | 252/78.3 |
| 4,261,848 | 4/1981 | Reedy et al. | 252/78.3 |
| 4,340,495 | 7/1982 | Brown, Jr. | 252/78.3 |
| 4,342,681 | 8/1982 | Idel et al. | 524/108 |

FOREIGN PATENT DOCUMENTS 7019682 4/1982 Japan .

*Primary Examiner*—Robert Wax

*Attorney, Agent, or Firm*—Steven H. Flynn

[57] ABSTRACT

Silicone fluids with the nominal structures RO—$D_x$—R where x is an integer having a value of from about 4 to about 60 and R is a 2-methylcyclohexyl group have been synthesized and used as hydraulic fluids.

These fluids exhibit superior viscosity, % rubber swell, % compressibility and air dissolubility characteristics in hydraulic systems.

8 Claims, No Drawings

2-METHYLCYCLOHEXOXY END BLOCKED ABA TYPE SILICONE FLUIDS AND THEIR USE AS BRAKE FLUIDS

FIELD OF THE INVENTION

The present invention relates to 2-methyl cyclohexoxy end-blocked ABA type silicone fluids and to a method of transmitting force through hydraulic system, such as in hydraulic brake systems, in which such a silicone fluid is present.

DESCRIPTION OF THE PRIOR ART

Conventional brake fluids are primarily organic polyethers. However, while these brake fluids have preformed adequately as hydraulic fluids, they possess certain undesirable tendencies, such as the tendency to dissolve paint, cause excess swelling of rubber parts with which they are in contact (rubber swell) and the tendency to absorb water (hygroscopicity) which may lead to corrosion of brake system components.

Attempts have therefore been made to provide silicone brake fluids which overcome the problems of polyether brake fluids while maintaining high performance standards necessary for brake fluids, such as those set forth in Department of Transportation Standard No. 5 (DOT 5).

Polydimethylsiloxane fluids have been utilized but they have been found to (1) cause shrinkage of rubber parts and (2) display a high air solubility, which undesirably increases their compressability.

Organic groups can be incorporated into the silicone fluid to achieve the desired rubber swell, or, alternatively, swell additives can be used to increase the degree of rubber swell. For example, U.S. Pat. No. 4,261,848 discloses sterically hindered ABA type silicone brake fluids having endblock groups containing at least ten carbon atoms. However, this fluid undesirably crystallizes at low temperatures and possesses poor shelf life stability. U.S. Pat. No. 3,984,449 teaches the use of certain silicone fluids having organic substituents as brake fluids. However, these silicone fluids which contain pendant organic groups attached to the silicone backbone, have undesirably high viscosities at low temperature and are economically unattractive.

OBJECTS OF THE INVENTION

It is therefore an object of the invention to provide a silicone fluid useful as a brake fluid which meets standard performance criteria and especially DOT-5 specifications.

Another object of the invention is to provide such a silicone brake fluid which is an economically feasible alternative to polyether brake fluids.

A further object of the invention is to provide a silicone fluid which does not exhibit high viscosities at low temperatures and further resists crystallization.

SUMMARY OF THE INVENTION

The present invention relates to alkoxysilane fluids of the formula:

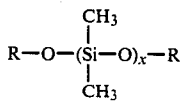

wherein R is a 2-methyl cyclohexyl group and x is an interger having a value of from about 4 to about 60. Preferably x has a value of from about 5 to about 25. Most preferably, x has a value of from about 14 to about 18.

These novel silicone fluids display low air solubility, low compressibility, a high flash point, low freezing point and a relatively low viscosity at −40° C.

DETAILED DESCRIPTION OF THE INVENTION

In accordance with the present invention, silicone fluids endcapped with 2-methylcyclohexoxy groups are provided. These fluids may be prepared by known processes. For example, these fluids can be prepared by reacting 2-methylcyclohexanol with polysiloxane fluids having end groups containing halogen atoms, such as chlorine, in the presence of organic or inorganic bases which function to capture the liberated HCl. Polysiloxane fluids containing other end groups, such as amines or sulfates, may also be reacted with 2-methylcyclohexanol to produce the fluids of this invention.

Siloxane fluids containing 2-methylcyclohexoxy end groups can also be obtained from the reaction of 2-methylcyclohexanol with cyclic tetramer $[(CH_3)_2SiO]_4$ under acid catalysis with removal of water from the reaction. These as well as additional methods of preparing alkoxyl end capped siloxane fluids are well known to those skilled in this art. See for example U.S. Pat. No. 2,834,748.

In a preferred embodiment of the present invention, x has a value of from about 5 to about 25. Most preferably, x has a value of from about 14 to about 18 thereby producing a fluid having a desirable rubber swell of about 8% in brake fluid applications.

While not wishing to be bound by any theory offered herein, the performance benefits exhibited by the composition of the present invention are believed to be due to the fact that the 2-methylcyclohexoxy-bearing molecule is sterically hindered, thereby providing protection against hydrolysis of the Si-O-C linkage which binds the group to the silicone chain. This results in greatly improved hydrolytic stability of the fluid when compared to conventional ABA fluids.

Moreover, the 2-methylcyclohexoxy group exists in both cis and trans configurations, the presence of which is believed to hinder crystallization of the fluid, thereby depressing its freezing point. Furthermore, the viscosity of the claimed alkoxysilane fluids does not increase greatly with increases in molecular weight. Therefore a wide range of molecular weights of the claimed alkoxysilanes are useful as hydraulic fluids.

When used in brake fluid applications the fluid of the invention having a value for x of from 14 to 18 possesses a rubber swell (EPDM rubber) of about 8% without the use of additives. If additional swell is necessary for certain applications, swell additives may be employed. However, the use of swell additives is not preferred since some additives, such as phosphate acid esters, can, under some conditions, cause decomposition of the fluid.

Other conventional brake fluid additives may be employed with the silicone fluid of the invention (e.g. diluents, corrosion inhibitors, dyes, etc.) Useful diluents include aromatic oils and high boiling esters. Corrosion inhibitors useful with the claimed fluids include dioctyl azelate, tributyl phosphate, trioctyl phosphate and tricreosol phosphate.

The claimed fluids of the present invention may also be employed in conjunction with other conventional brake fluids. However, the benefits arising from the use of the claimed fluids will decrease in such applications, due to the dilution of the fluids of the present invention.

In another aspect, the present invention provides a method of transmitting force through use of the claimed fluids, such as in a hydraulic brake system.

Generally, a hydralic brake system consists of a hydraulic reservoir containing the hydraulic brake fluid, a hydraulic activating means by which an operator of a vehicle translates mechanical pressure into hydraulic pressure, a hydraulic activated means, such as the pistons in a brake cylinder or caliper in a disc brake system, and hydraulic lines which connect the aforementioned components of the hydraulic brake system.

While the above discussion has been directed to the advantages of the silicone fluid of the invention as a brake fluid, it should be understood that these silicone fluids would also be useful as hydraulic fluids for use in hydraulic systems other than brake systems.

Whereas the exact scope of the instant invention is set forth in the appended claims, the following specific examples are provided to further illustrate certain aspect of the present invention. These examples are set forth for illustration only and are not to be construed as limitations on the present invention. All parts and percentages are by weight unless otherwise specified.

EXAMPLES

All reactions were performed in a dry inert atmosphere. Prior to use, all glassware was washed successively with solutions of KOH/ethanol; water/5% HCl; water; followed by oven drying.

Example 1

Catalyst Preparation

Toluene (375 mls), $[(CH_3)_2SiO]_4$ (375 grams, 1.27 mol.), and tetramethylammonium hydroxide pentahydrate (39 grams, 0.026 mol.), were added to a two liter round bottom flask fitted with a magnetic stir bar, a thermometer connected to a Thermo-Watch regulator, and a Dean Stark trap fitted with a water condenser. The apparatus was then charged with argon gas under reduced pressure. The flask was then heated to 70° C. at a pressure of 200 mm Hg. Water was removed by azeotropic distillation with toluene. The excess toulene was then removed, leaving the catalyst as an oil.

As a test of the activity of the catalyst, a drop of the catalyst was added to a small quantity of $[(CH_3)_2SiO]_4$ at 95° C. Gellation of the material occurred within two minutes.

Comparative Examples A–D

Four ethoxy terminated linear dimethylsilicone fluids were prepared with the nominal structures $$C_2H_5O—[—Si(CH_3)_2O—]_x—C_2H_5$$

where x was equal to 5, 6, 10 and 14. The description of the fluid wherein x=10 is described below. The reaction mixture for the production of the other fluids is set forth in Table 1 hereto.

A five liter three neck round bottom flask fitted with a mechanical stirrer, a thermometer connected to a Thermo-Watch regulator and a dry ice condenser under positive argon pressure was charged with diethoxydimethylsilane (413.6 grams, 2.8 mol) and $[(CH_3)_2SiO]_4$ (1858 grams, 6.3 mol). The reaction mixture was heated to 95° C. and 15 grams of the catalyst of Example 1 was added in 5 gram increments until a persistent amber color was observed in the solution.

The process was monitored using gas chromatograph analysis of samples taken periodically from the reaction mixture. Gas chromatograph analysis confirmed that no consumption of $[(CH_3)_2SiO]_4$ occurred until the reaction solution exhibited a persistent amber color. Equilibrium was established after about 36 hrs, after which the reaction mixture was heated to 140° C. for one hour to destroy the catalyst. It was noted that the amber colored solution turned colorless as the catalyst was destroyed. The reaction mixture was then cooled to room temperature and filtered through glass wool. The ethoxy-capped colorless fluid was recovered in yields of about 98%.

Examples 2–9

Eight 2-methylcycloxy-capped fluids were prepared using the ethoxy-capped fluids of Examples A–D through the transesterification procedure described below in reference to the reaction of the ethoxy-capped fluid wherein x=10. The reaction mixture used in the production of the other fluids is set forth in Table 1 hereto.

A three liter round bottom flask was fitted with a magnetic stir bar, a thermometer connected to a Thermo-Watch regulator and a Dean Stark trap fitted with a water cooled condenser under positive argon pressure. The flask was charged with ethoxy end-capped dimethylsiloxane fluid (814 grams, 1.0 mol.), 2-methycyclohexanol (228 grams, 2 mol.), an aqueous solution of potassium acetate (10 grams, 0.102 mol.), and trifluoroacetic acid (18 grams, 0.159 mol.) in 100 mls of toluene. The reaction mixture was stirred and gradually heated to 120° C. The ethanol liberated during the reaction was continuously remove via the Dean Stark trap as a toluene azeotrope. Toluene was periodically added to the reaction mixture to replace that lost from the flask. The concentration of toluene was kept at a minimum to prevent buildup of cyclics in the event any redistribution of the fluid occurred during the transesterification. Samples were withdrawn prior to the toluene additions to monitor by gas chromatography the extent of the transesterification reaction. The reaction was carried to approximately 97% completion in about twenty hours. The reaction mixture was then neutralized with sodium bicarbonate (25 grams), filtered and stripped of volitiles at 90° C. at 0.25 mm Hg for three hours.

Comparative Examples E–L

The procedure of Examples 2–9 was used (with the use of t-butanol in place of 2-methylcyclohexane) to prepare t-butoxy end-capped fluids. The procedure also differed slightly in that some butanol was added periodically to the reaction mixture since some was lost in the distillation. The specific reaction mixtures are set forth in Table I hereto.

Comparative Test Criteria

Desirable properties for a silicone brake fluid ranked in order of importance include economical synthesis, a −40° C. viscosity of less than 1000 cSt, no crystallization, a maximum EPDM rubber swell of 8%, minimum compressibility (less than 2%), adequate shelf life, minimum air solubility and a flash point greater than 260° C.

Comparative tests were run using ethoxy and t-butoxy end-capped fluids. The fluids were elevated for air solubility, low temperature viscosity, % compressibility and % rubber swell as summarized in Table II.

As shown in Table II, in all cases the low temperature viscosities were well below the maximum viscosity of 1000 centistokes.

The % compressibilities of the fluid of the instant invention at 100° C. and 2000 psi was less than with the ethoxy- and t-butoxy-capped fluids. The 1.8% compressibility displayed by the 2-methylcyclohexoxy-capped fluid of the invention comprises a 25% improvement over the less hindered ethoxy and the more hindered t-butoxy-capped fluids.

The ability of the 2-methylcyclohexoxy end-blocked ABA type silicone fluids to swell rubber is shown in Table II. The target value for EPDM rubber swell in a brake fluid is 8 volume % in 72 hours at 120° C. For each type of end group, the rubber swell decreased as the nominal number of x units in the fluid increased. However, the 2-methylcyclohexoxy-capped fluids exhibited superior swell characteristics when compared to t-butoxy and ethoxy-capped fluids.

The 2-methylcyclohexoxy end-capped fluids of the present invention also gave the lowest air solubilities, ranging from 13.2 to 14.5 mls of air/100 mls. fluid. Moreover, the air solubility did not vary significantly as the nominal number of x units in the fluid was varied from 5 to 14. In contrast, air solubilities of t-butoxy end-capped fluids increased from 14.4 to 17.4 mls of air/100 mls of fluid as the nominal number of x units was varied from 5 to 14. The ethoxy end-capped fluids showed the highest air solubilities but the air solubility decreased slightly from 19.7 to 17.4 mls of air/100 mls of fluid as x varied from 5 to 14. Typical air solubilities for long chain linear dimethylsiloxane oils are in the range of 16 to 17 mls of air/100 mls of fluid. The claimed fluids therefore exhibit improved performance in air solubility over both the linear dimethylsiloxane fluids and the other alkoxysiloxane fluids tested.

TABLE I

SYNTHESES OF FLUIDS

| FLUID | | $(EtO)_2Si(CH_3)_2$ | Cyclic $D_4$ | Product |
|---|---|---|---|---|
| $EtOD_5Et$ | | 148.3 g | 296 g | 444 g |
| $EtOD_6Et$ | | 593.2 g | 1480 g | 2072 g |
| $EtOD_{10}Et$ | | 413.6 g | 1858 g | 2264 g |
| $EtOD_{14}Et$ | | 296.6 g | 1924 g | 2220 g |
| | x | $EtOD_xEt$ | t-Butanol | Product |
| $t\text{-}BuOD_5t\text{-}Bu$ | 5 | 444 g | 148 g | 500 g |
| $t\text{-}BuOD_6t\text{-}Bu$ | 6 | 518 g | 148 g | 574 g |
| $t\text{-}BuOD_{10}t\text{-}Bu$ | 10 | 814 g | 148 g | 870 g |
| $t\text{-}BuOD_{14}t\text{-}Bu$ | 14 | 1110 g | 148 g | 1166 g |
| | x | $EtOD_xET$ | MeCyOH | Product |
| $MeCyOD_5MeCy$ | 5 | 444 g | 228 g | 580 g |
| $MeCyOD_6MeCy$ | 6 | 518 g | 228 g | 654 g |
| $MeCyOD_{10}MeCy$ | 10 | 814 g | 228 g | 950 g |
| $MeCyOD_{14}MeCy$ | 14 | 1110 g | 228 g | 1246 g |

Et = ethyl
t-Bu = tertiary butyl
MeCy = 2-methylcyclohexyl
MeCyOH = 2-methylcyclohexanol
D = $(CH_3)_2SiO$

TABLE II

| STRUCTURE[1] | FLUID PROPERTIES AIR[2] SOLUBILITY | LOW TEMP[3] VISCOSITY | % COMPRESSIBILITY[4] | SWELL[5] |
|---|---|---|---|---|
| $EtOD_5Et$ | 19.7 | 9.0 | — | 11.5 |
| $EtOD_6Et$ | 19.3 | 15.9 | — | 9.3 |
| $EtOE_{10}Et$ | 18.6 | 31.1 | 2.4 | 5.2 |
| $EtOD_{14}Et$ | 17.4 | 49.6 | 2.3 | 1.9 |
| $MeCyOD_5CyMe$ | 14.3 | 83 | — | 39.4 |
| $MeCyOD_6CyMe$ | 13.2 | 143 | 1.8 | 17.6 |
| $MeCyOD_{10}CyMe$ | 14.5 | 131 | 1.8 | 11.9 |
| $MeCyOD_{14}CyMe$ | 14.0 | 143 | — | 10.1 |
| $t\text{-}BuOD_5t\text{-}Bu$ | 16.5 | 34.1 | — | 11.7 |
| $t\text{-}BuOD_6t\text{-}Bu$ | 14.4 | 81 | 2.3 | 13.2 |
| $t\text{-}BuOD_{10}t\text{-}Bu$ | 15.8 | 78.1 | 2.4 | 4.7 |
| $t\text{-}BuOD_{14}t\text{-}Bu$ | 17.4 | 101 | — | 2.6 |
| Target | low as possible | <1000 | low as possible | 8.0 |

[1]Nominal Structure
[2]Air Solubility in mls of air / 100 ml sample.
[3]Viscosity in cSt at −40° C.
[4]% Compressibility at 100° C. and 2000 psi.
[5]Rubber Swell (% by volume) of EPDM for 72 hours at 120° C. as measured by SAE J1703 Nov. 1983.
MeCy = 2-methylcyclohexyl
t-Bu = t-butyl
Et = ethyl
D = $(CH_3)_2SiO$

I claim:

1. A liquid alkoxysiloxane of the nominal formula:

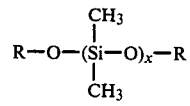

wherein R is a 2-methylcyclohexyl group and x is an integer having a value of from about 4 to about 60.

2. The alkoxysiloxane of claim 1 wherein x is an integer having a value of from 5 to 25.

3. The alkoxysiloxane of claim 1 wherein x is an integer having a value of from 14 to 18.

4. The alkoxysiloxane of claim 1 wherein x has a value of about 16.

5. A process for transmitting force through a hydraulic brake system having a hydraulic activating means, hydraulic activated means and hydraulic lines inter connecting said hydraulic activating means with said hydraulic activated means comprising substantially filling said hydraulic activating means, said hydraulic activated means and said hydraulic lines with a hydraulic fluid comprising a liquid alkoxysiloxane of the formula:

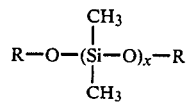

wherein R is 2-methylcyclohexyl and x is an integer having a value of from about 4 to about 60, and applying a force to said hydraulic activating means to activate said hydraulic activated means.

6. The process of claim 5 wherein x is an integer having a value of from 5 to 25.

7. The process of claim 6 wherein x is an integer having a value of from 14 to 18.

8. The process of claim 7 wherein x has a value of about 16.

* * * * *